US006420669B1

(12) United States Patent
Shenker et al.

(10) Patent No.: US 6,420,669 B1
(45) Date of Patent: Jul. 16, 2002

(54) TOGGLE MECHANISM FOR TOGGLE SWITCHES

(75) Inventors: David Shenker, Oceanside; David B. Balaban, Hauppauge; Michael Ostrovsky, Brooklyn; John LiBretto, N. Massapequa, all of NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 09/566,647

(22) Filed: May 8, 2000

Related U.S. Application Data

(60) Provisional application No. 60/133,312, filed on May 10, 1999.

(51) Int. Cl.[7] ..... H01H 3/00; H01H 9/00
(52) U.S. Cl. ..... 200/339; 200/288
(58) Field of Search ..... 200/553–557, 200/329–339, 315, 316, 286–288

(56) References Cited

U.S. PATENT DOCUMENTS 5,262,678 A * 11/1993 Flowers et al. ..... 200/335 X
5,608,196 A * 3/1997 Hall et al. ..... 200/339 X
6,005,308 A * 12/1999 Bryde et al. ..... 200/339 X

* cited by examiner

*Primary Examiner*—J. R. Scott
(74) *Attorney, Agent, or Firm*—Paul J. Sutton

(57) ABSTRACT

A modular toggle mechanism assembly has a housing assembly, a toggle handle pivotally mounted in the housing assembly and movable between a first position and a second position, biasing means for selectively biasing the toggle handle in the first position or the second position, and an actuator arm connected to the toggle handle and capable of selectively actuating an external switching device as a function of the position of the toggle handle. The modular toggle assembly also includes an external switching device in selective association with the toggle handle. The housing assembly includes an upper housing and a lower housing configured to be secured together, wherein a portion of the toggle handle extends from an opening in the upper housing for user operation of the handle. The biasing means is a toggle spring positioned in the lower housing, and the assembly further includes a toggle arm extending from the toggle handle which contacts at least a portion of the toggle spring when the toggle handle is moved between the first and second positions. The toggle spring is a flat spring member located in a channel and supported on substantially distal ends by a pair of support arms. The toggle arm makes contact with substantially the middle of the spring member through a predetermined arc defined by the rotational movement of the toggle arm.

3 Claims, 5 Drawing Sheets

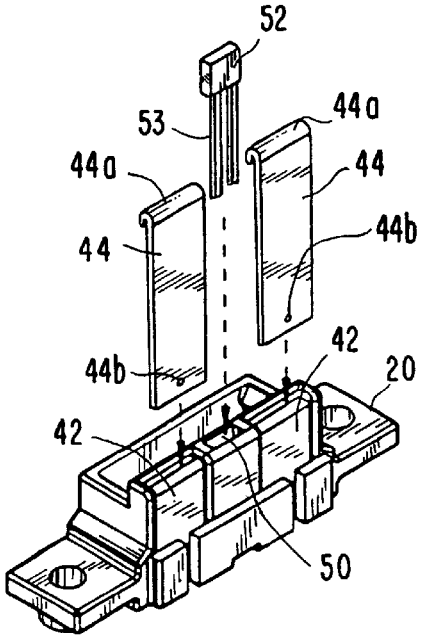
FIG. 4A
FIG. 4B
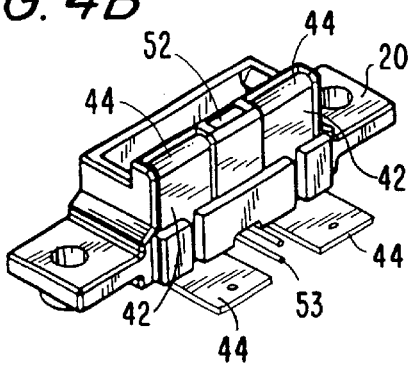
FIG. 4C
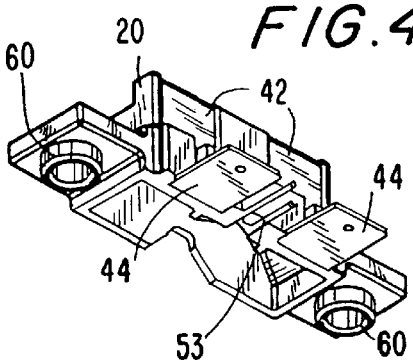
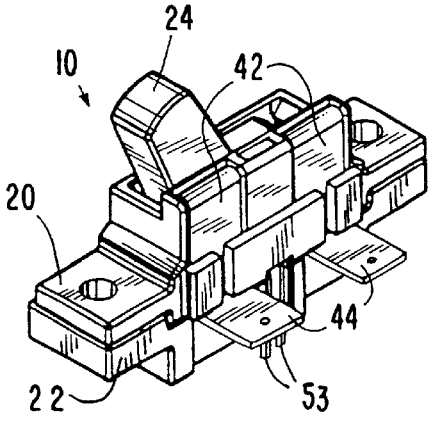
FIG. 4D
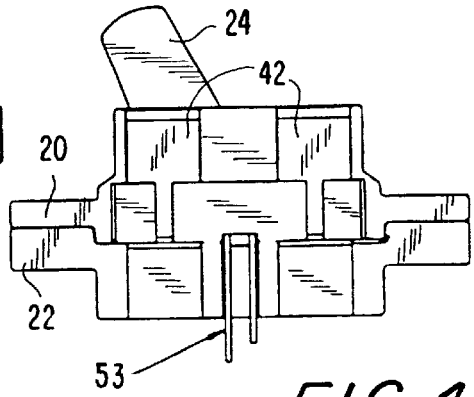
FIG. 4E 38
24
40
26
38
40

24
40
26
40
42
30
20
44
53
44
24a
62
24
28

22

28
22
34
36
32

24
20

26

22
24

26

TOGGLE MECHANISM FOR TOGGLE SWITCHES

CROSS REFERENCE TO RELATED APPLICATIONS

This application is based on and claims filing priority of co-pending U.S. Provisional Application Serial No. 60/133,312, filed on May 10, 1999, entitled TOGGLE MECHANISM FOR TOGGLE SWITCHES, which is incorporated by reference herein.

BACKGROUND OF THE INVENTION

The present application generally relates to a toggle mechanism for electrical switches. More particularly, the present application relates to a modular toggle mechanism that makes and breaks an electrically conductive path independent of the toggle action of the mechanism and includes at least one alternative switching operation. The modularity of the present invention facilitates its use with one or a variety of switching environments such that manufacturing economy, as well as uniformity of appearance, are achieved.

SUMMARY OF THE INVENTION

Provided is a modular toggle assembly that has a housing assembly, a toggle handle pivotally mounted in the housing assembly and movable between a first position and a second position, biasing means for selectively biasing the toggle handle in the first position or the second position, and an actuator arm connected to the toggle handle and capable of selectively actuating an external switching device as a function of the position of the toggle handle. The modular toggle assembly also includes an external switching device in selective association with the toggle handle.

The housing assembly includes an upper housing and a lower housing configured to be secured together, wherein a portion of the toggle handle extends from an opening in the upper housing for user operation of the handle.

The biasing means is a toggle spring positioned in the lower housing, and the assembly further includes a toggle arm extending from the toggle handle which contacts at least a portion of the toggle spring when the toggle handle is moved between the first and second positions. The toggle spring is a flat spring member located in a channel and supported on substantially distal ends by a pair of support arms. The toggle arm makes contact with substantially the middle of the spring member through a predetermined arc defined by the rotational movement of the toggle arm.

The modular toggle assembly also has means for attenuating noise generated by motion of the toggle arm with respect to the toggle spring, which are a first attenuating bumper and a second attenuating bumper, each attached to the toggle handle. The first bumper is in close proximity to the spring member when the toggle handle is in the first position, and the second bumper is in close proximity to the spring member when the toggle handle is in the second position.

The modular toggle assembly also has a pair of touch sensitive plates, each having one end formed in a hook shape and located within a respective channel in the upper housing separated by a spacing. An LED is located within the spacing between the touch sensitive plates. The assembly also has a circuit board in electrical contact with the LED, the switching device, and the touch sensitive plates.

BRIEF DESCRIPTION OF THE DRAWING

Preferred embodiments of the present application are described herein with reference to the drawings in which similar elements are given similar reference characters, wherein:

FIG. 4A is a top perspective view of the assembly of components to an upper housing;

FIG. 4B is a top perspective view of the assembled upper housing;

FIG. 4C is a bottom perspective view of the assembled upper housing;

FIG. 4D is a top perspective view of the assembled upper and lower housings with the toggle handle;

FIG. 4E is a side plan view of the assembled housings of FIG. 4D;

DETAILED DESCRIPTION OF THE PREFERRED EMBODIMENT

Figure 1:
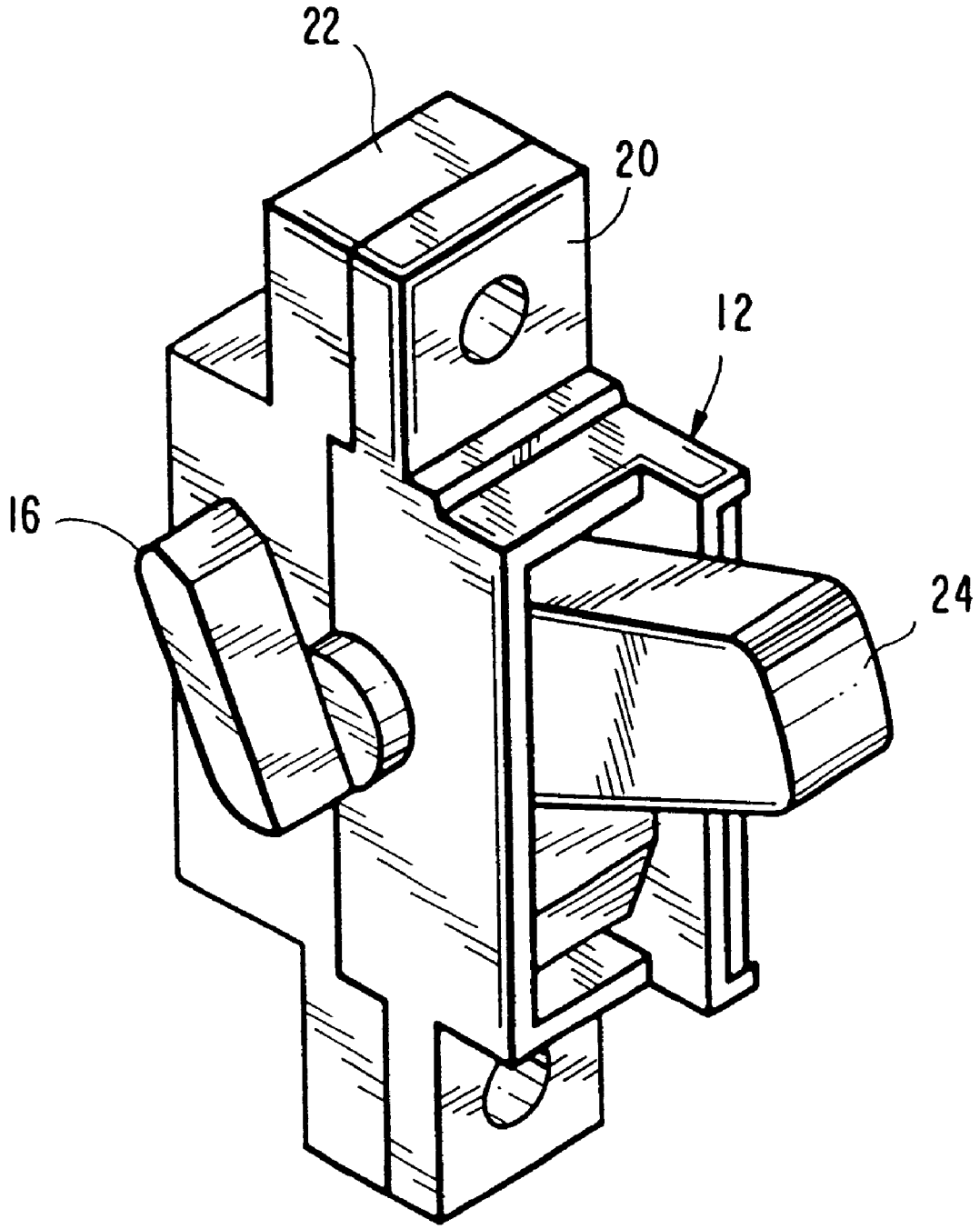
FIG. 1 is a perspective view of an exemplary embodiment of a toggle assembly according to the present application.
Figure 2:
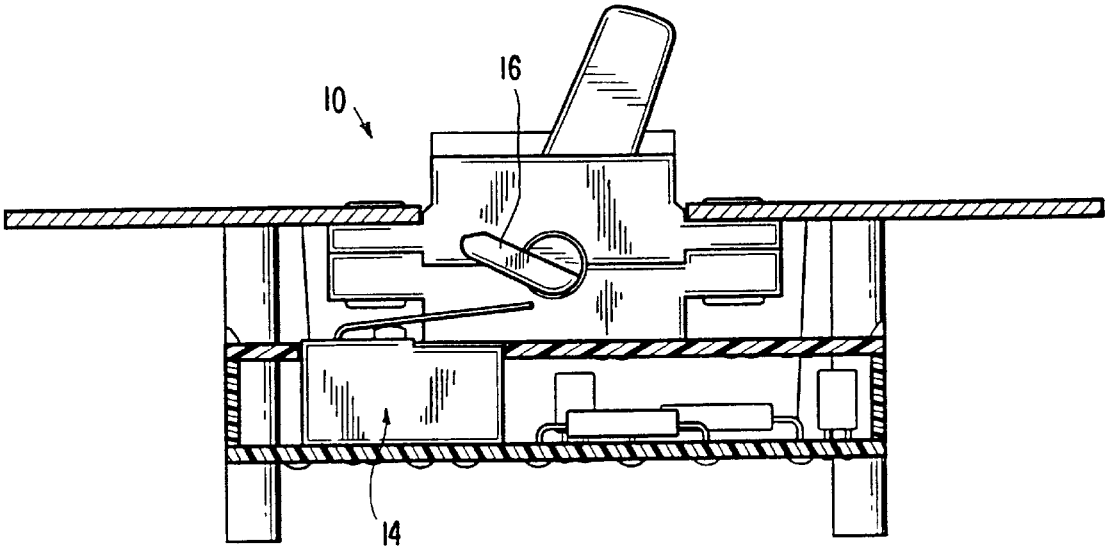
FIGS. 2 and 3 are side elevational views showing the operation of a toggle mechanism that includes a toggle assembly and an external switch moved from a first position to a second position, respectively.
Figure 3:
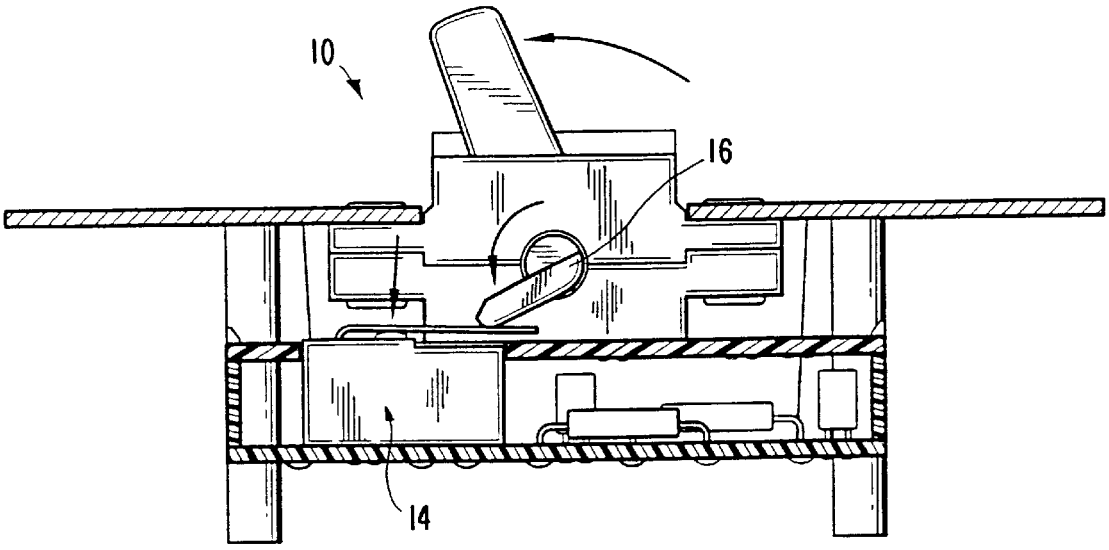
Figures 5A, 5B, 5C, 5D, 5E, 5F, 5G, 5H:
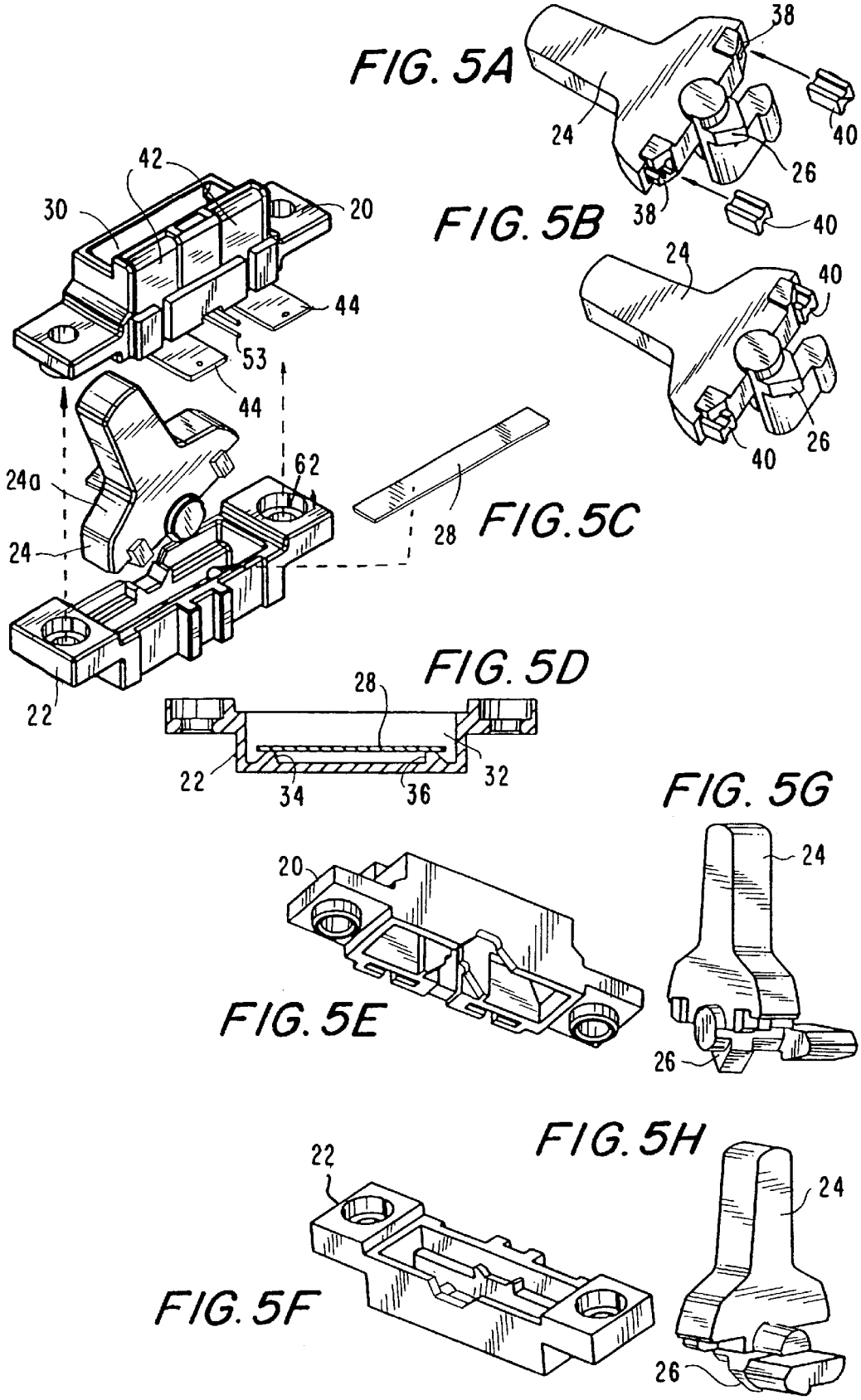
FIG. 5A is an exploded bottom perspective view of the assembly of the toggle handle.
FIG. 5B is a bottom perspective view of the assembled toggle handle.
FIG. 5C is an exploded top perspective view of the assembly of upper and lower housings of FIG. 4D.
FIG. 5D is a side cross-sectional view of the lower housing.
FIG. 5E is a bottom perspective view of the upper housing before assembly.
FIG. 5F is a top perspective view of the lower housing before assembly.
FIG. 5G is a front perspective view of the toggle handle.
FIG. 5H is a rear perspective view of the toggle handle.

The toggle mechanism 10 includes a toggle assembly 12 (seen in FIG. 1) and an external switching device 14 (seen in FIGS. 2 and 3), which is preferably a micro-switch. When the toggle assembly 12 is actuated, an actuator arm 16 of the toggle assembly 12 selectively activates the external switching device 14, as shown in FIGS. 2 and 3.

Referring to FIGS. 4A–6B, the toggle assembly 10 includes an upper housing 20, a lower housing 22, a toggle handle 24 having a toggle arm 26 extending therefrom and a toggle spring 28. The toggle handle 24 is pivotally mounted to the housings 20, 22 and extends at least partially through an opening 30 in the upper housing 20 at a location suitable for user operation of the toggle mechanism. The toggle handle 24 moves between ON and OFF positions to respective travel stops defined by the opening in the upper housing 20. The toggle spring 28 is located in a channel 32 of the lower housing 22 on two support arms 34 and 36. The toggle spring 28 is preferably a flat spring and is free to deflect at any point along its length between the support arms.

Preferably, when the toggle handle 24 is positioned in the housing, a top face of the toggle handle 24*a* is framed by the upper housing 20 to provide sufficient clearance for proper toggle operation, while minimizing gaps between the toggle handle and the upper housing. A portion of the toggle handle within the housing is preferably constructed with one or more bumper pockets 38. Bumpers 40, preferably, made of a noise attenuating material such as Santoprene, are inserted into the bumper pockets 38. The bumpers 40 attenuate (or silence) noise generated by operation of the toggle assembly 12.

Figure 6A:
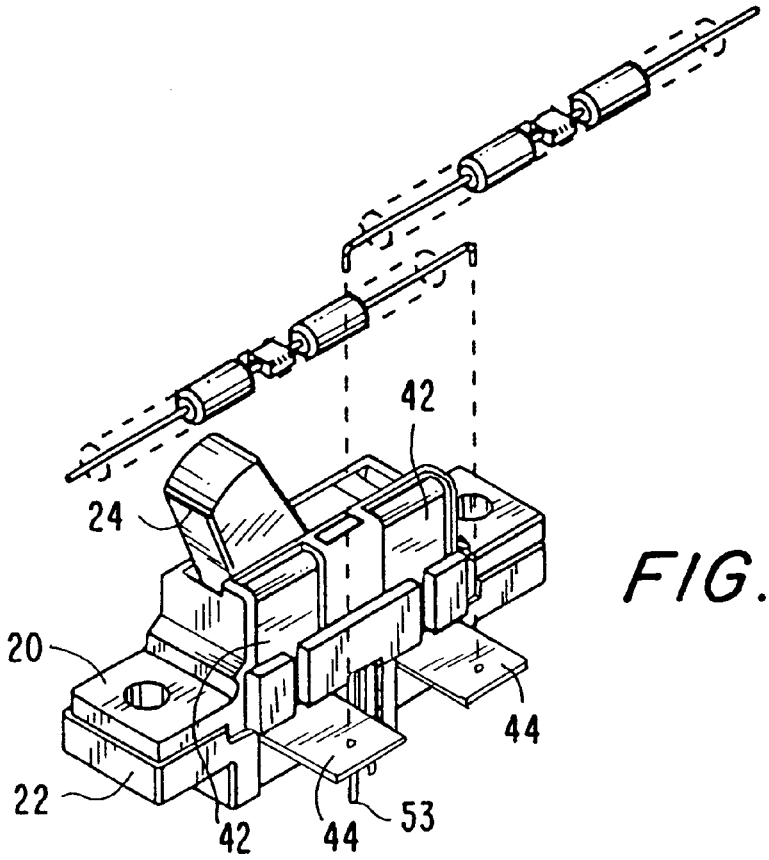
FIG. 6A is a top perspective view of the assembled toggle assembly for connection to electronic circuitry.
Figure 6B:
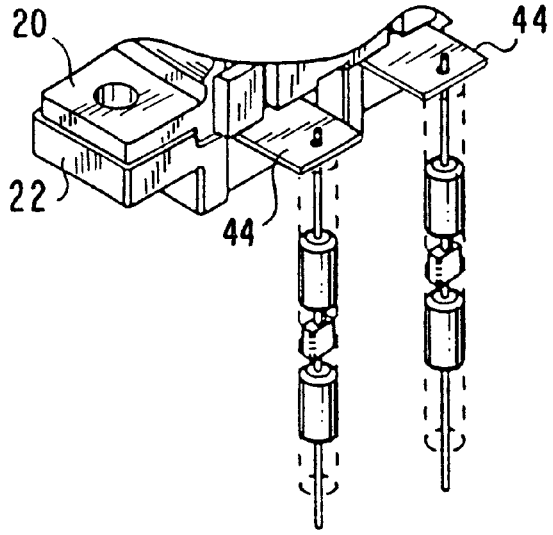
FIG. 6B is a partial top perspective view of the toggle assembly of FIG. 6A connected to electronic circuitry.

The upper housing 20 also includes channels 42 in which touch sensitive plates 44 are inserted. Each touch sensitive plate 44 is preferably shaped in the form of a "shepherds hook" (seen in FIG. 4A) so that when a plate 44 is inserted into a channel 42 in the upper housing 20, the hook portion 44*a* of the plate 44 engages a portion of the upper housing 20. After the hook portion 44*a* of the plate 44 engages the upper housing 20, a flat end 44*b* of the plate 44 is bent, preferably at an angle of 90° (as seen in FIG. 4*b*), to secure the plate 44 to the upper housing 20. The touch sensitive plates 44 may be brass or nickel-plated brass touch plates. The touch sensitive plates 44 can be connected to electronic circuitry (as seen in FIGS. 6A and 6B) to perform alternative switching operations, depending upon which plate 44 is touched.

An opening 50 is formed in an area of the upper housing 20 between the two touch plate channels 42. A light emitting device 52, such as an light emitting diode (LED) is positioned in the opening 50 and is, preferably, coupled to the external switching device 14 or electronic circuitry associated with the external switching device, so that the LED illuminates when the toggle mechanism is in an OFF position, and the LED turns off when the toggle mechanism is in an ON position. Illuminating the LED aids in the locating of the toggle assembly in a darkened room.

When the upper and lower housings are to be joined together, step joints in each housing intermesh to align the housings. Additionally, the upper housing may include dowel posts 60 and the lower housing may include dowel receiving sockets 62 which align the housings. Preferably, the dowel receiving sockets 62 have frictional locking "crush grooves" to secure the upper housing to the lower housing. Rivets through each dowel and socket may be used to further secure the upper housing to the lower housing.

As noted, the actuator arm 16 extends from the toggle handle 24, preferably at a 90° angle, and through the housings 20 and 22. The actuator arm 16 is configured to interact with the external switching device 14 to cause the device to make or break the conductive path, as described above.

With reference to the embodiments shown in the figures, toggle action of the toggle assembly 12 will now be described. As noted, the toggle spring 28 is free to deflect at any point along its length between the support arms 34 and 36, and the toggle handle 24 is movable between the ON and OFF positions. As the toggle handle 24 rotates or pivots, preferably in a predetermined arc, the toggle arm 26 presses the toggle spring 28 down. When the toggle arm 26 reaches a point, which is about one half of its total travel distance, the toggle arm 26 has reached its lowest point in its arc so that the toggle spring 28 is at maximum deflection. As the toggle arm continues to travel along its predetermined arc, the toggle arm 26 permits the toggle spring 28 to relax and move upward. The spring's stored energy then causes the toggle handle to complete its travel to the intended stop, e.g., ON position or OFF position. The depressing and releasing of the toggle spring 28 when the toggle handle 24 is operated between the ON and OFF positions provides conventional toggle action and feel.

As noted, the noise attenuating bumpers 40 are located to attenuate noise generated by the toggle action. In the configuration shown, one bumper contacts a surface of the toggle spring 28 when the toggle handle 24 is resting at a stop. This contact attenuates noise generated by the operation of the toggle mechanism. Other techniques for attenuating or silencing noise generated by the toggle action are also contemplated.

What is claimed is:

1. A modular toggle assembly comprising:

a housing assembly including:
an upper housing; and
a lower housing, wherein the upper and lower housing are configured to be secured together;

a toggle handle pivotally mounted in the housing assembly and movable between a first position and a second position, wherein a portion of the toggle handle extends from an opening in the upper housing for user operation of the handle;

biasing means for selectively biasing the toggle handle in the first position or the second position, the biasing means including:
a toggle spring positioned in the lower housing, the toggle spring being a flat spring member located in channel and supported on substantially distal ends by a pair of support arms; and
a toggle arm extending from the toggle handle which contacts at least a portion of the toggle spring when the toggle handle is moved between the first and second positions;
wherein the toggle arm makes contact with substantially the middle of the spring member of the toggle spring through a predetermined arc defined by the rotational movement of the toggle arm;

an actuator arm connected to the toggle handle and capable of selectively actuating an external switching device as a function of the position of the toggle handle;

an external switching device in selective association with the toggle handle;

means for attenuating noise generated by motion of the toggle arm with respect to the toggle spring, wherein the means for attenuating noise includes:
a first attenuating bumper; and
a second attenuating bumper, each attached to the toggle handle;
wherein the first bumper is in close proximity to the spring member when the toggle handle is in the first position; and
wherein the second bumper is in close proximity to the spring member when the toggle handle is in the second position; and a pair of touch sensitive plates, each of said plates having one end thereof formed in a hook shape, each of said plates located within a respective channel in the upper housing separated by a spacing.

2. The modular toggle assembly of claim 1 further comprising an LED located within the spacing between the touch sensitive plates.

3. The modular toggle assembly of claim 2 further comprising a circuit board in electrical contact with the LED, the switching device, and the touch sensitive plates.

* * * * *